US009088844B2

(12) United States Patent
Ohashi

(10) Patent No.: US 9,088,844 B2
(45) Date of Patent: Jul. 21, 2015

(54) SOUND IMAGE LOCALIZATION CONTROL APPARATUS

(75) Inventor: Noriyuki Ohashi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 420 days.

(21) Appl. No.: 13/427,348

(22) Filed: Mar. 22, 2012

(65) Prior Publication Data

US 2012/0250869 A1 Oct. 4, 2012

(30) Foreign Application Priority Data

Mar. 30, 2011 (JP) ..... 2011-076474

(51) Int. Cl.
*H04R 5/00* (2006.01)
*H04R 5/04* (2006.01)

(52) U.S. Cl.
CPC ..... *H04R 5/04* (2013.01)

(58) Field of Classification Search
CPC ..... H04S 1/00; H04S 1/002; H04S 1/005; H04S 1/007; H04S 3/002; H04S 3/004; H04S 3/006; H04S 3/008; H04S 3/02; H04S 5/00; H04S 5/005; H04S 7/00; H04S 7/30; H04S 7/301; H04S 7/302; H04S 7/304; H04S 7/303; H04S 7/307; H04S 7/308; H04S 7/40; H04S 2400/09; H04S 2400/11; H04S 2420/01; H04S 2420/05; H04S 2420/13; H04R 2499/13; H04R 2430/23; H04R 2205/024; H04R 2205/021
USPC ..... 381/1, 17, 18, 22, 23, 80, 109, 302, 381/303, 304, 305, 306, 307, 309, 310, 61, 381/119, 120, 12, 300, 301, 27, 59, 118
See application file for complete search history.

(56) References Cited

U.S. PATENT DOCUMENTS

| | | | | |
|---|---|---|---|---|
| 5,572,591 | A | 11/1996 | Numazu et al. | |
| 5,844,993 | A | 12/1998 | Iida et al. | |
| 2003/0007648 | A1* | 1/2003 | Currell | 381/61 |
| 2005/0220312 | A1 | 10/2005 | Kasai et al. | |
| 2007/0183608 | A1 | 8/2007 | Willems | |
| 2007/0288110 | A1 | 12/2007 | Inoue et al. | |

FOREIGN PATENT DOCUMENTS

| | | |
|---|---|---|
| JP | 04-251294 | 9/1992 |
| JP | 6-303699 A | 10/1994 |

(Continued)

OTHER PUBLICATIONS

Corresponding Japanese Office Action dated Jan. 26, 2015 with English translation.

*Primary Examiner* — Leshui Zhang
(74) *Attorney, Agent, or Firm* — Crowell & Moring LLP

(57) ABSTRACT

A sound image localization control apparatus includes: a distributing unit configured to produce first and second audio signals which have a time difference, from an input audio signal, and configured to supply the first audio signal to one of a plurality of speakers; and a virtual-sound source processing unit configured to produce a virtual-sound source signal for localizing a sound source at a virtual sound source position in a space where the plurality of speakers are disposed, which is to be supplied to the one of the plurality of speakers, based on the second audio signal.

5 Claims, 7 Drawing Sheets

(56) References Cited

FOREIGN PATENT DOCUMENTS

| | | | |
|---|---|---|---|
| JP | 8-205297 | A | 8/1996 |
| JP | 3368835 | B2 | 1/2003 |
| JP | 2007-251831 | | 9/2007 |
| JP | 2007-288677 | A | 11/2007 |
| JP | 4306029 | B2 | 7/2009 |
| JP | 4567049 | B2 | 10/2010 |
| JP | 2011-4261 | | 1/2011 |

* cited by examiner

FIG. 8 (b) Prior Art

SOUND IMAGE LOCALIZATION CONTROL APPARATUS

BACKGROUND OF THE INVENTION

The present invention relates to a technique for controlling sound image localization.

A technique in which, as shown in FIG. 8(*a*), for example, volumes of sounds emitted respectively from speakers SP1 and SP2 that are placed in front of the listener LP are adjusted to localize the sound image at a position on the straight line connecting the speakers is known as panning. A transfer function (head transfer function) simulating the transfer characteristics of sounds which reach the right and left ears of the listener from a position (virtual sound source position) that is different from the installation positions of the speakers SP1 and SP2 of FIG. 8(*a*) is convoluted with audio signals to be supplied respectively to the speakers SP1 and SP2, thereby causing the sound image to be localized at the virtual sound source position so that auditory sensation in which the sound source exists at the virtual sound source position is perceived by the listener. Hereinafter, a sound source which is localized at a virtual sound source position is referred to as "virtual sound source", and that which actually exists at the position of a speaker is referred to as "real sound source". Patent References 1 and 2 disclose a technique in which a virtual sound source is treated in the same manner as a real sound source, and a sound image is localized at a position on the straight line connecting the virtual sound source and the real sound source by distributing signal components between the virtual sound source and the real sound source (adjustment of the gain: panning), thereby causing the sound image to be localized in an arbitrary direction including the height direction.

(Patent Reference 1) Japanese Patent No. 4,306,029
(Patent Reference 2) JP-A-6-303699
(Patent Reference 3) JP-A-2007-288677
(Patent Reference 4) JP-A-8-205297
(Patent Reference 5) Japanese Patent No. 4,567,049
(Patent Reference 6) Japanese Patent No. 3,368,835

However, the technique disclosed in Patent References 1 and 2 is considered to have a limitation that, when a sound image is to be localized at a position on the straight line connecting the virtual sound source and the real sound source, an audio signal corresponding to the virtual sound source and that corresponding to the real sound source cannot be supplied to the same speaker, because of the following reason.

FIG. 8(*b*) is a view showing an example of the signal process in the technique disclosed in Patent Reference 1. More specifically, FIG. 8(*b*) is a view showing an example of the signal process in the case where audio signals (hereinafter, referred to as virtual-sound source signals) XV1 and XV2 which cause the virtual sound source VSS to be localized through sounds emitted from the speakers SP1 and SP2 in FIG. 8(*a*), and an audio signal XR which drives the speaker SP1 as the real sound source RSS1 (i.e., an audio signal indicative of a sound emitted from the position of the speaker SP1: hereinafter, referred to as a real-sound source signal) are produced from the same input audio signal X, and a sound image SI is localized at a position on the straight line connecting the virtual sound source VSS and the real sound source RSS1, by performing signal distribution between the real-sound source signal and the virtual-sound source signals.

In the signal process shown in FIG. 8(*b*), the audio signal to be supplied to the speaker SP1 is produced by adding the real-sound source signal XR and the virtual-sound source signal XV1 together in an adder 30. As shown in FIG. 8(*b*), the real-sound source signal XR is a signal which is obtained by applying a gain adjustment by a gain controller 10*r* to the input audio signal X. On the other hand, the virtual-sound source signals XV1 and XV2 are obtained by applying a gain adjustment by a gain controller 10*v* to the input audio signal X, and then performing a convolution of the head transfer function H by a virtual-sound source processing section 20.

It seems that, in order to localize the sound image SI at a position on the straight line connecting the virtual sound source VSS and the real sound source RSS1, in a similar manner as the sound image localization by signal distribution between real sound sources, the gains Cr and Cv of the gain controllers 10*r* and 10*v* are adequately adjusted so as to satisfy following Exp. (1):

$$0 \le Cr \le 1, 0 \le Cv \le 1, \text{ and } (Cr)^2 + (Cv)^2 = 1 \quad (1)$$

However, the real-sound source signal XR and virtual-sound source signal XV1 which are obtained by the signal process shown in FIG. 8(*b*) are obtained from the same audio signal (in the example shown in FIG. 8(*b*), the input audio signal X), the amplitudes and phases of the two signals have constant relationships, and the signals are highly correlated with each other. When the real-sound source signal XR and the virtual-sound source signal XV1 are added together by the adder 30, therefore, the signals are mixed with each other, a sound which is obtained by applying a filter process with filter characteristics of (Cr+CvH) to the audio signal X is output from the speaker SP1, and a sound is just heard in such a manner that the virtual sound source VSS is localized at an unexpected position, or that the listener LP hears a sound in which the frequency characteristics are deteriorated, as if the sound is emitted from the speaker SP1, with the result that the virtual sound source VSS is not localized at an expected position. Since the virtual sound source VSS is not localized at an expected position, also localization of the sound image SI is disturbed.

Usually, at least two speakers are used in localization of a virtual sound source. In the case where, for example, front right and left, and rear right and left, or a total of four speakers are used, therefore, it is possible also to avoid overlapping of speakers to which real-sound source signals are output, and those to which virtual-sound source signals are output. Specifically, in the case where virtual-sound source signals are output to the rear right and left speakers, real-sound source signals are supplied to the front right and left speakers, and, in the case where virtual-sound source signals are output to the front right and left speakers, real-sound source signals are supplied to the rear right and left speakers. In this mode, however, virtual-sound source processing sections must be separately disposed in the sets of the front right and left speakers, and the rear right and left speakers, respectively, thereby causing a problem that the configuration of an audio apparatus is complicated.

SUMMARY

It is therefore an object of the invention to provide a technique in which a sound image can be satisfactorily localized in an arbitrary direction including the height direction without performing a complicated process and with a reduced number of speakers.

In order to achieve the object, according to the invention, there is provided a sound image localization control apparatus comprising: a distributing unit configured to produce first and second audio signals which have a time difference, from an input audio signal, and configured to supply the first audio signal to one of a plurality of speakers; and a virtual-sound source processing unit configured to produce a virtual-sound source signal for localizing a sound source at a virtual sound source position in a space where the plurality of speakers are disposed, which is to be supplied to the one of the plurality of speakers, based on the second audio signal.

The distributing unit may include gain controllers, and gains in the gain controllers correspond to the first and second audio signals, respectively. The distributing unit may determine the gains in the gain controllers so that one of the gains in the gain controllers corresponding to a succeeding one of the first and second audio signals has a value larger than a reference value, and a sum of squares of the gains in the gain controllers has a constant value, and the reference value is one of gains in the gain controllers in a case where a sound image is localized between a position of one of the plurality of speakers and a position which is the virtual sound source position and in which a speaker is disposed.

The virtual sound source position may be positioned at an upper side in the space.

According to the invention, there is also provided a sound image localization control apparatus comprising: a distributing unit configured to produce first and second audio signals which have a time difference, from an input audio signal; a real-sound source processing unit configured to produce a real-sound source signal, to be supplied to one of a plurality of speakers, based on the first audio signal; and a virtual-sound source processing unit configured to produce a virtual-sound source signal for localizing a sound source at a virtual sound source position in a space where the plurality of speakers are disposed, based on the second audio signal, and configured to supply the virtual-sound source signal to the one of the plurality of speakers.

According to the invention, there is also provided a sound image localization control method comprising: producing first and second audio signals which have a time difference, from an input audio signal; supplying the first audio signal to one of a plurality of speakers; producing a virtual-sound source signal for localizing a sound source at a virtual sound source position in a space where the plurality of speakers are disposed, based on the second audio signal; and supplying the virtual-sound source signal to the one of the plurality of speakers.

DETAILED DESCRIPTION OF EMBODIMENTS

Hereinafter, the principle of the invention will be described before a description of an embodiment of the invention.

A: Principle of the Invention

Figure 1:
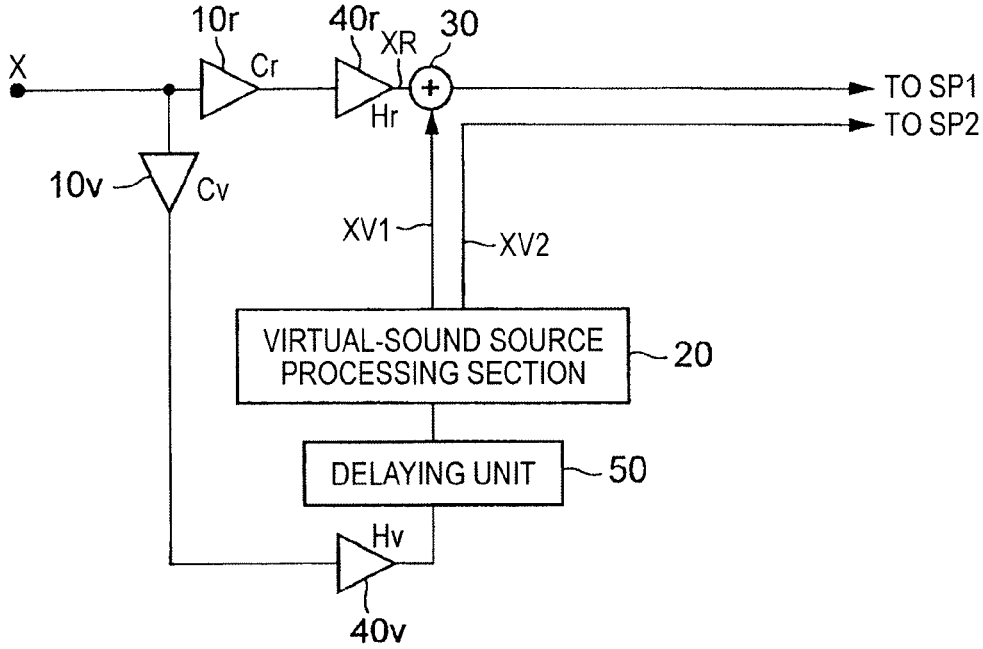
FIG. 1 is a view illustrating the principle of the invention.
Figure 8:
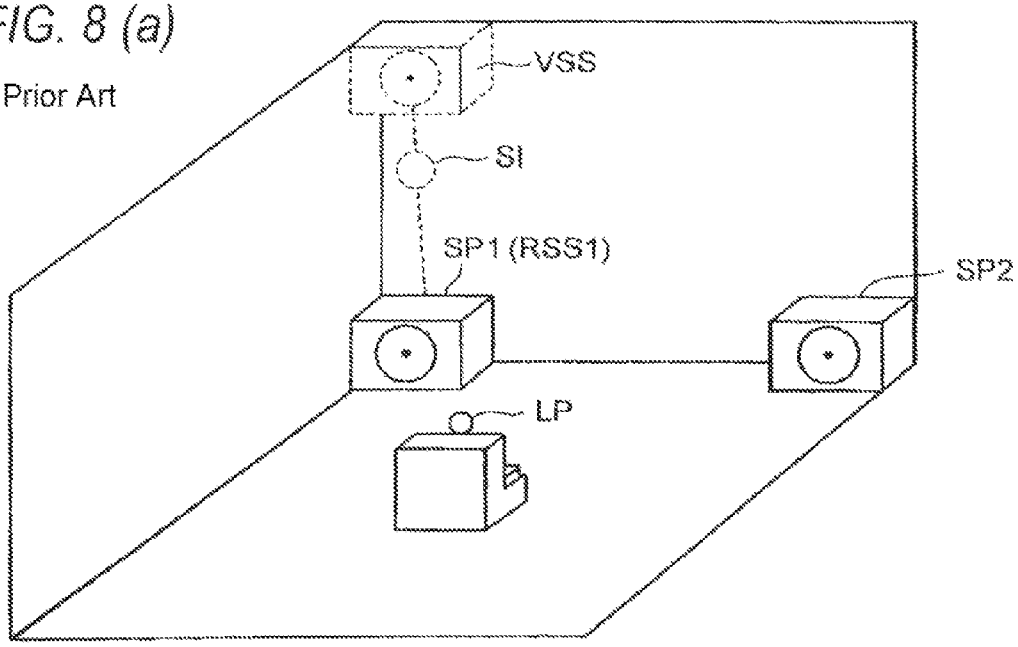
FIG. 8 (a) Prior Art
FIGS. 8(*a*) and 8(*b*) are views illustrating a problem of the related art.
Figure 8:
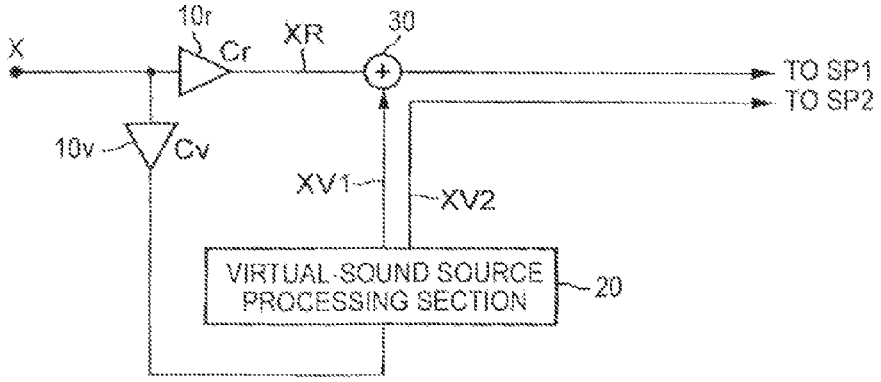
FIG. 8 (a) Prior Art

FIG. 1 is a view showing an example of a signal process in which the virtual sound source VSS is localized by sounds emitted from the speakers SP1 and SP2 of FIG. 8(*a*), and a process of causing the speaker SP1 to function as the real sound source RSS1 and performing localization of the sound image SI at a position on the straight line connecting the virtual sound source VSS and the real sound source RSS1 is realized in accordance with the principle of the invention. In FIG. 1, the components identical with those shown in FIG. 8(*b*) are denoted by the same reference numerals. As apparent from comparison of FIGS. 1 and 8(*b*), the signal process shown in FIG. 1 is different from that shown in FIG. 8(*b*) in that the signal process includes gain adjustments by gain controllers 40*r* and 40*v*, and a process of providing a delay to signal components of the virtual sound source VSS by a delaying unit 50.

As shown in FIG. 1, the real-sound source signal XR corresponding to the real sound source RSS1 is produced by applying, to the input audio signal X, a gain adjustment by the gain controller 10*r* and a gain adjustment by the gain controller 40*r*. On the other hand, signal components XV1 and XV2 of the virtual sound source VSS are produced by applying gain adjustments by the gain controllers 10*v* and 40*v* to the input audio signal X, providing a delay to the resulting signals by the delaying unit 50, and then performing a virtual-sound source process by the virtual-sound source processing section 20. In other words, the gain controllers 10*r* and 10*v*, the gain controllers 40*r* and 40*v*, and the delaying unit 50 which are shown in FIG. 1 play a role of a distributing unit which produces first and second audio signals having a time difference, from the input audio signals, and which supplies the first and second audio signals to the virtual-sound source processing section 20 and one of the two speakers to which the virtual-sound source signal produced by the virtual-sound source processing section is given, respectively.

Similarly with the above-described gain adjustments in FIG. 8(*b*), the gain adjustments by the gain controllers 10*r* and 10*v* of FIG. 1 are performed for realizing a process of localizing the sound image SI at a position on the straight line connecting the virtual sound source VSS and the real sound source RSS1 by distributing signal components of the real sound source and the virtual sound source. Therefore, the gain Cr in the gain controller 10*r*, and the gain Cv in the gain controller 10*v* are determined so as to satisfy Exp. (1) above in accordance with the position of the sound image SI.

In FIG. 1, the gain Hr in the gain controller 40*r*, and the gain Hv in the gain controller 40*v* are values which are determined by a ratio of the gain Cr in the gain controller 10*r* to the gain Cv in the gain controller 10*v*, and the delay amount in the delaying unit 50, and determined so as to satisfy following Exp. (2). The reason of performing the gain adjustments by the gain controllers 40*r* and 40*v* will be described later.

$$0 \le Hr \le Hv \text{ and } (Cr \times Hr)^2 + (Cv \times Hv)^2 = 1 \quad (2)$$

The delaying unit 50 is realized by, for example, writing and reading data in and from a memory, and used for delaying the signal components of the virtual sound source VSS with respect to those of the real sound source RSS1, thereby lowering the correlation between them. In the case where the input audio signal X is nonstationary and the time variation of the frequency distribution is large, the correlation between the signal components of the virtual sound source VSS and real sound source RSS1 which are originally the same audio signal is low, and, even when the both signal components are supplied to the same speaker (in the example shown in FIG. 1, the speaker SP1), the localization sensation of the virtual sound source VSS is not impaired. Experiments conducted by the applicant show that it is preferable to set the amount of the delay applied by the delaying unit 50 from 5 to 25 ms, because, when the amount of the delay applied by the delaying unit 50 exceeded 30 ms, the signal components of the virtual sound source VSS and those of the real sound source RSS1 were separately heard on the time axis, and localization of the sound image SI by panning was disabled, and, in the case of a delay of 5 ms or shorter with respect to various usual nonstationary audio signals, the effect due to lowering of the correlation was insufficient.

When a delay is applied to the signal components of the virtual sound source VSS as described above, the precedence effect such as the Haas effect is produced. The precedence effect is a phenomenon in which, when the same audio signal is supplied to two speakers while producing a time difference, to output respectively sounds, the listener senses localization at the speaker in which the output timing is earlier, and does not sense localization at the other speaker. In the signal process shown in FIG. 1, the gain controllers 40*r* and 40*v* are disposed, and the gain Hv in the gain controller 40*v* is made larger than the gain Hr in the gain controller 40*r* as indicated in Exp. (2) above (namely, the signal components of the virtual sound source VSS which is the succeeding side is enhanced), whereby the precedence effect is relaxed.

Specifically, the gain Hv in the gain controller 40*v* is made larger than a reference value which is a value of a gain in a case where a sound image is localized between a position of a speaker and the position of the virtual sound source VSS in which a speaker is disposed, and a sum of squares of the gain Hv and the gain Hr has a constant value.

In the signal process shown in FIG. 1, namely, the application of a delay to the signal components of the virtual sound source VSS causes the correlation of the signal components and those of the real sound source RSS1 to be lowered, so that the localization sensation of the virtual sound source VSS is prevented from being lost. The process in which the loss of the localization sensation of the virtual sound source VSS is prevented from occurring by the application of a delay seems to be effective in the case where the input audio signal X indicates, for example, a music piece or sound effects in a movie or a game. This is because it is often that an audio signal of this kind is a nonstationary audio signal which is nonstationary, and in which the time variation of the frequency distribution is large. Therefore, it is contemplated that the signal process shown in FIG. 1 is preferably used in an audio apparatus for reproducing a music, a movie, or the like, a game machine, etc.

In the signal process shown in FIG. 1, moreover, the gain in the gain adjustment of the signal components of the virtual sound source VSS is raised from the reference value Cv which is determined in accordance with the localization position of the sound image SI, to HvCv while satisfying the relationships indicated in Exp. (2) above, whereby the generation of the precedence effect due to the application of a delay is relaxed. This enables the sound image SI to be satisfactorily localized at a position on the straight line connecting the virtual sound source VSS and the real sound source RSS1.

Referring to FIG. 1, the case has been described where the virtual sound source VSS is localized by the sounds emitted from the speakers SP1 and SP2, the speaker SP1 is caused to function as the real sound source RSS1, and the sound image SI is localized at a position on the straight line connecting the virtual sound source VSS and the real sound source RSS1. As shown in FIG. 3, alternatively, the sound image SI may be localized within a triangle in which the apexes are at the set positions of the virtual sound source VSS and the real sound sources RSS1 and RSS2, by localizing the virtual sound source VSS by the sounds emitted from the speakers SP1 and SP2, causing the speaker SP1 to function as the real sound source RSS1, and distributing the signal components of the virtual sound source VSS and the real sound sources RSS1 and RSS2. In order to realize this, the signal process shown in FIG. 2 may be performed in place of the signal process shown in FIG. 1.

Figure 2:
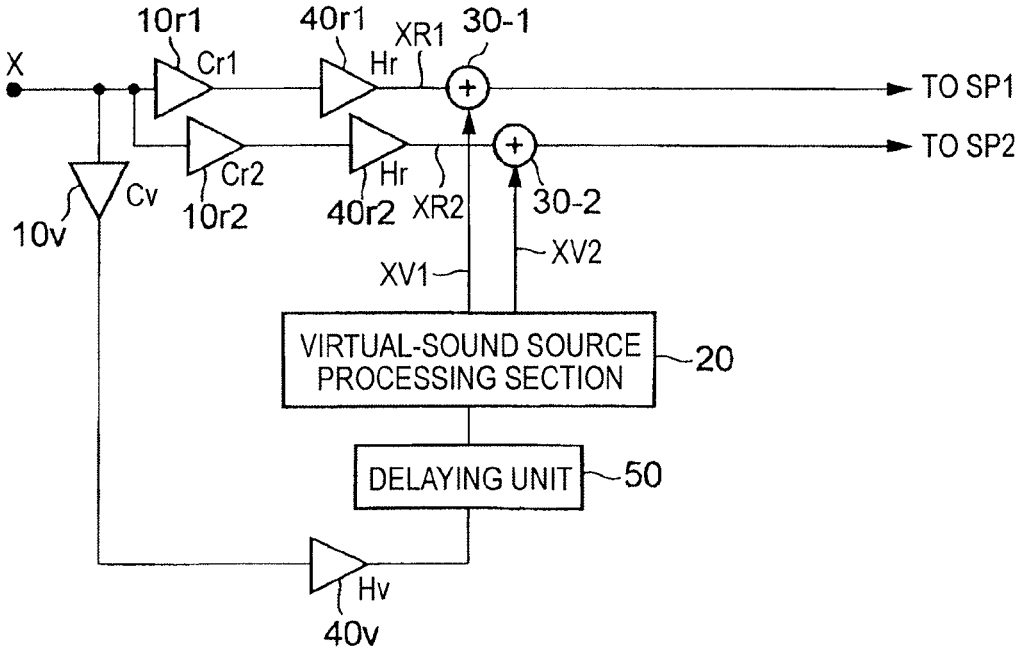
FIG. 2 is a view illustrating the principle.
Figure 3:
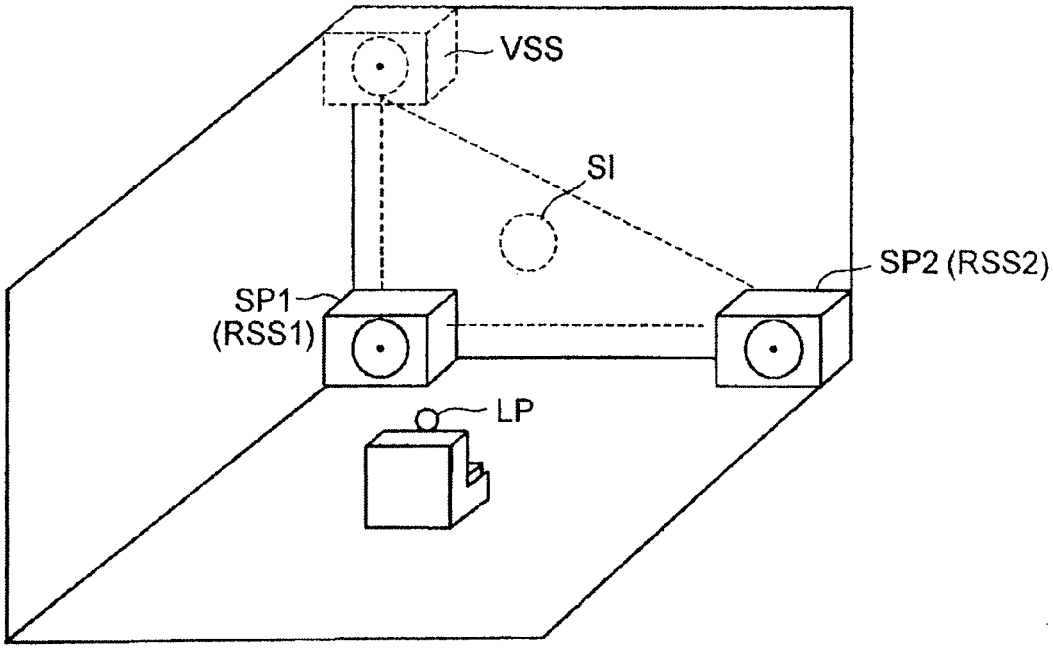
FIG. 3 is a view illustrating the principle.

In the signal process shown in FIG. 2, in the audio signals supplied respectively to the speakers SP1 and SP2, the virtual-sound source signals XV1 and XV2 corresponding to the virtual sound source VSS are produced in the same manner as in the signal process shown in FIG. 1. By contrast, a real-sound source signal XR1 which causes the speaker SP1 to function as the real sound source RSS1 is produced by applying gain adjustments by gain controllers 10*r*1 and 40*r*1 to the input audio signal X, and a real-sound source signal XR2 which causes the speaker SP2 to function as the real sound source RSS2 is produced by applying gain adjustments by gain controllers 10*r*2 and 40*r*2 to the input audio signal X. The audio signal to be supplied to the speaker SP1 is produced by adding the real-sound source signal XR1 and the virtual-sound source signal XV1 together in an adder 30-1, and the audio signal to be supplied to the speaker SP2 is produced by adding the real-sound source signal XR2 and the virtual-sound source signal XV2 together in an adder 30-2.

When, in FIG. 2, the gain Cr1 in the gain controller 10*r*1, the gain Cr2 in the gain controller 10*r*2, and the gain Cv in the gain controller 10*v* are determined so as to satisfy following Exp. (3), in accordance with the position at which the sound image SI is to be localized, and the gain Hr in the gain controllers 40*r*1 and 40*r*2, and the gain Hv in the gain controllers 40*v* are determined so as to satisfy following Exp. (4), it is possible to localize at a desired position in a triangle in which the apexes are at the set positions of the virtual sound source VSS and the real sound sources RSS1 and RSS2, in a similar manner as the signal process shown in FIG. 1.

$$0 \le Cr1 \le 1, 0 \le Cr2 \le 1, 0 \le Cv \le 1, \text{ and } (Cr1)^2 + (Cr2)^2 + (Cv)^2 = 1 \quad (3)$$

$$0 \le Hr \le Hv \text{ and } (Cr1 \times Hr)^2 + (Cr2 \times Hr)^2 + (Cv \times Hv)^2 = 1 \quad (4)$$

In the above, the principle of the invention has been described. In the description above, the two speakers are used in localization of a virtual sound source. Alternatively, localization of a virtual sound source may be realized by using only one speaker. In essence, a configuration is requested where a virtual-sound source signal is supplied to at least one of a plurality of speakers, and a virtual sound source is localized by using a sound(s) emitted from the speaker(s).

B: Embodiment

Next, an embodiment of the invention to which the above-described principle is applied will be described.

Figure 4:
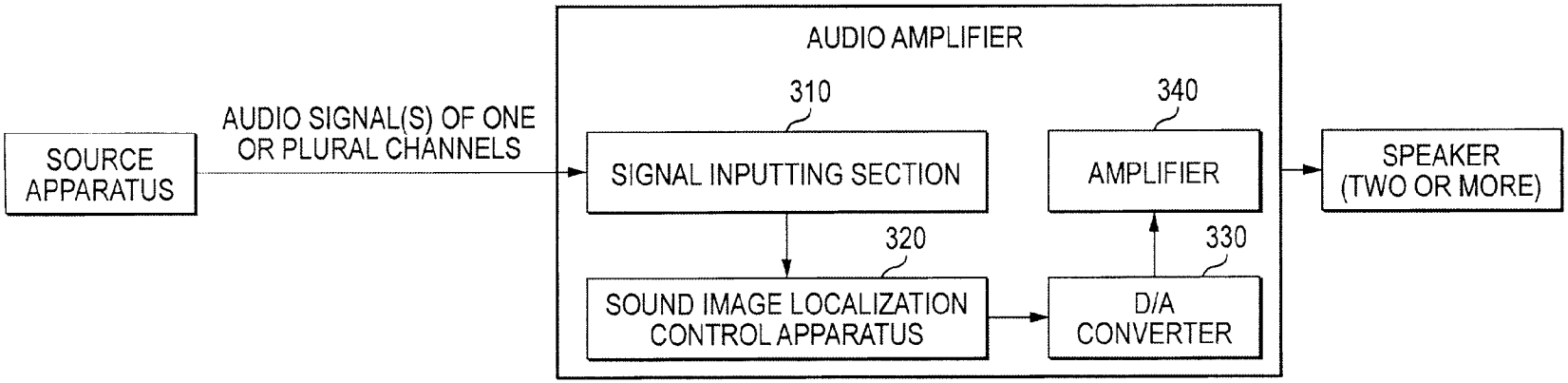
FIG. 4 is a view showing an example of the configuration of an audio amplifier of an embodiment of the invention.

FIG. 4 is a block diagram showing an example of the configuration of an audio apparatus which is an embodiment of the invention. As shown in FIG. 4, for example, the audio apparatus is an audio amplifier which receives an audio signal(s) of one or plural channels output from a source apparatus such as a DVD player, and which drives and controls a plurality of speakers. As shown in FIG. 4, the audio amplifier includes: a signal inputting section 310 which performs decoding and the like on the audio signals output from the source apparatus; a sound image localization control apparatus 320 which applies various signal processes for sound image localization to the audio signals supplied to the signal inputting section 310; a D/A converter 330 which applies D/A conversion to the audio signals that have undergone the signal processes by the sound image localization control apparatus 320; and an amplifier 340 which amplifies the analog audio signals output from the D/A converter 330, and which outputs the amplified signals to the plurality of speakers. In the audio amplifier shown in FIG. 4, the sound image localization control apparatus 320 executes the signal process according to the principle of the invention.

Figure 5:
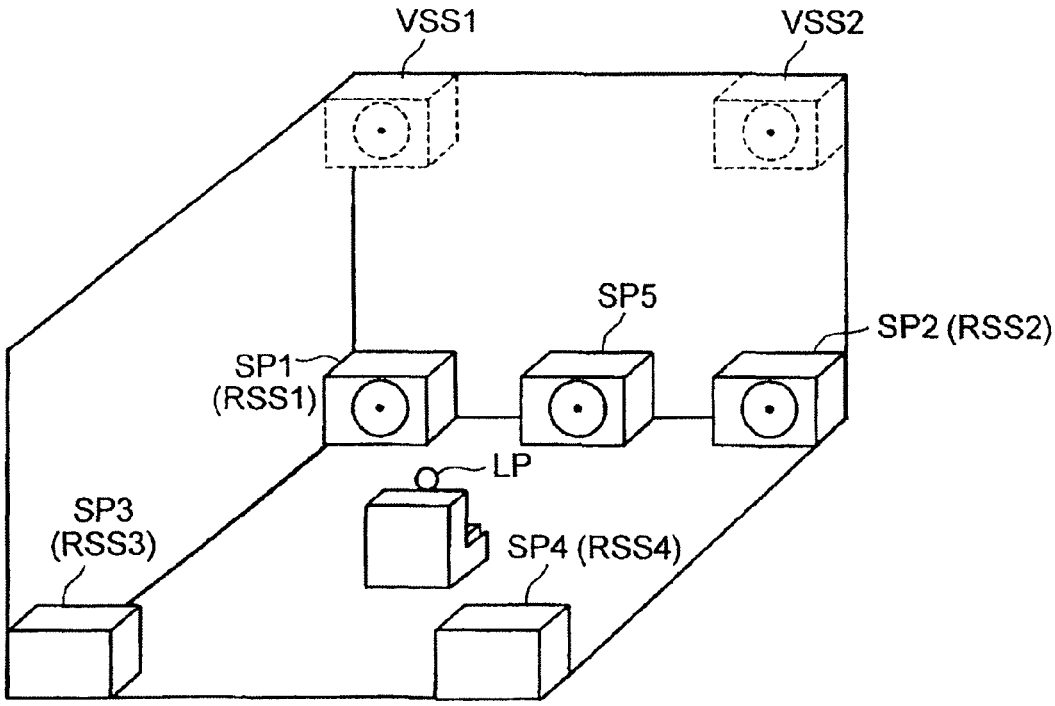
FIG. 5 is a view showing an example of the arrangement of speakers SP1 to SP5 connected to the audio amplifier, and an example of settings of real sound sources RSS1 to RSS4 and virtual sound sources VSS1 and VSS2.

The source apparatus shown in FIG. 4 outputs audio signals X1 to X5 of five channels. The speakers SP1, SP2, and SP5 which are placed in front of the listener LP as shown in FIG. 5, and the speaker SP3 and SP4 which are placed in the back side of the listener, or a total of five speakers are connected to the audio apparatus. Hereinafter, the signal process executed by the sound image localization control apparatus 320 will be described by taking as an example the case where, as shown in FIG. 5, the speakers SP1 to SP4 are caused to function as real sound sources RSS1 to RSS4, the virtual sound sources VSS1 and VSS2 are localized by sounds emitted from the speakers SP1 and SP2, and a sound image is localized at a position among the two virtual sound sources and the four real sound sources. In the five speakers shown in FIG. 5, the speaker SP5 is used for reproducing a sound which is to be clearly localized only at the position of the speaker (for example, a sound of the center channel, such as a dialogue in a movie).

Figure 6:
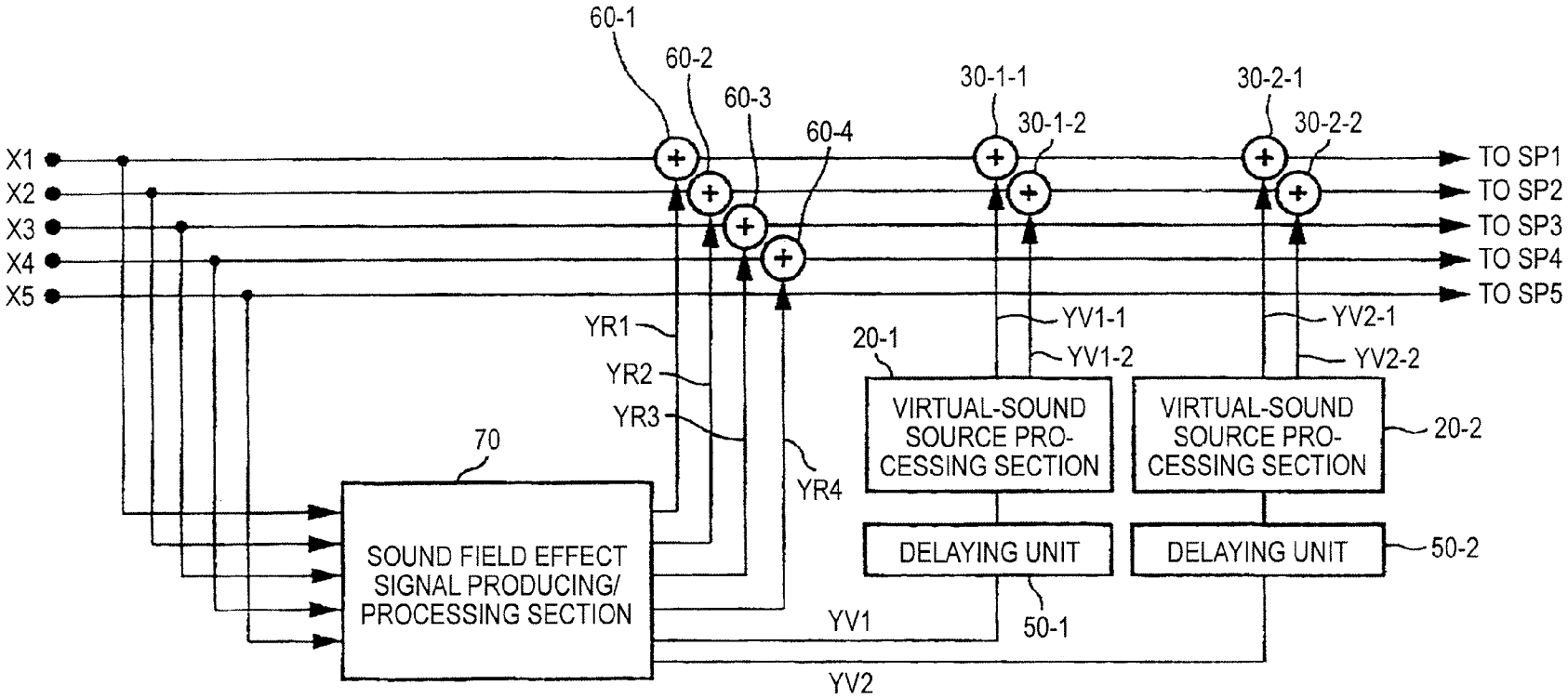
FIG. 6 is a view showing an example of a signal process which is executed by a sound image localization control apparatus 320 of the audio amplifier.

FIG. 6 is a view showing an example of the configuration of the sound image localization control apparatus 320.

As shown in FIG. 6, the sound image localization control apparatus 320 includes: adders 60-*m* (m=1 to 4), adders 30-*i*-*j* (i=1 and 2, j=1 and 2), virtual-sound source processing sections 20-*i*, delaying units 50-*i*, and a sound field effect signal producing/processing section 70. For example, the sound image localization control apparatus 320 in the embodiment is a DSP, and the functions of the sections shown in FIG. 6 are realized as software processes in the DSP. The sound field effect signal producing/processing section 70 produces sound field effect signals YRm (m=1 to 4) and YVi (i=1 and 2), indicative of sound field effects (for example, echo) for localizing each of real sound sources RSSm (m=1 to 4) and virtual sound sources VSSi (i=1 and 2), from the input audio signals X1 to X5, and then outputs the sound field effect signals.

Each of the adders 60-*m* (m=1 to 4) in FIG. 6 adds the sound field effect signal YRm and the input audio signal Xm together, and outputs the result of the addition as the real-sound source signal corresponding to the real sound source RSSm. Namely, the adders 60-*m* (m=1 to 4) and the sound field effect signal producing/processing section 70 play a role of a real-sound source processing unit which produces the real-sound source signal corresponding to the real sound source RSSm, from the input audio signals X1 to X5. The delaying units 50-*i* (i=1 and 2) and virtual-sound source processing sections 20-*i* in FIG. 6 play the same role as the delaying unit 50 and virtual-sound source processing section 20 in FIG. 1. Each of the delaying units 50-*i* (i=1 and 2) delays the sound field effect signal YVi to produce a time difference between the signal and the sound field effect signals YRm (m=1 to 4). Each of the virtual-sound source processing sections 20-*i* (i=1 and 2) produces virtual-sound source signals YVi-j (j=1 and 2) corresponding to the virtual sound source VSSi, from the sound field effect signal YVi, and then outputs the virtual-sound source signals. Each of the adders 30-*i*-*j* (i=1 and 2, j=1 and 2) in FIG. 6 adds the virtual-sound source signal YVi-j to the real-sound source signal (i.e., Xj+YRj) corresponding to the real sound source RSSj, and outputs the result of the addition as an audio signal to be supplied to the speaker SPj.

Figure 7:
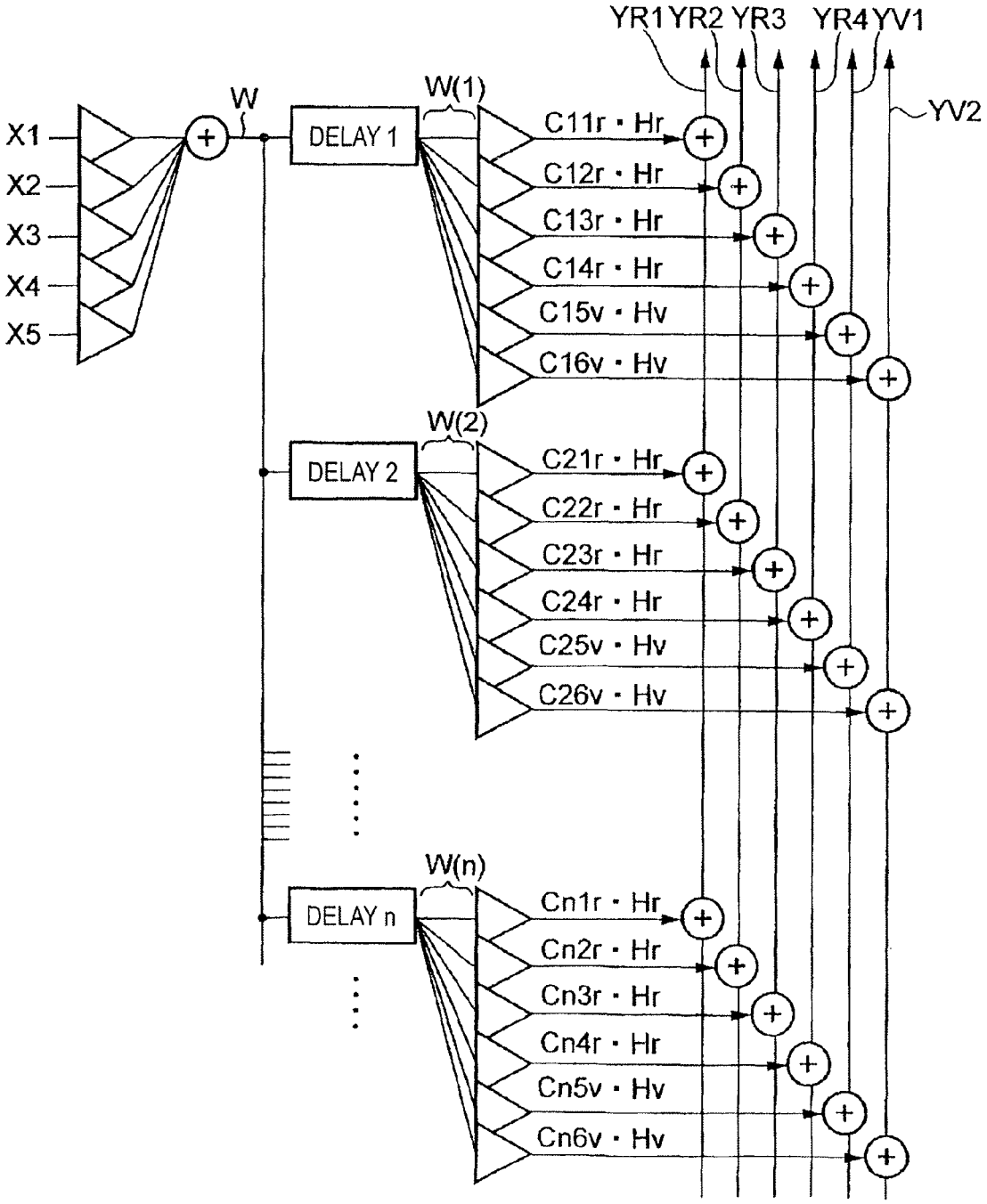
FIG. 7 is a view showing an example of the configuration of a sound field effect signal producing/processing section 70 of the sound image localization control apparatus 320.

FIG. 7 is a view showing an example of the configuration of the sound field effect signal producing/processing section 70. In the sound field effect signal producing/processing section 70, as shown in FIG. 7, the sound field effect signals YR1 to YR4 corresponding respectively to the real sound sources RSS1 to RSS4 are produced by multiplying and summing products of a sound image localization coefficient Cnkr (k=1 to 4) and a correction coefficient Hr, with the delayed signals W (n) which are obtained by delaying added signals W of the input audio signals X1 to X5 by a delaying process n (n=1 to N). Moreover, the sound field effect signal producing/processing section 70 multiplies and sums products of a sound image localization coefficient Cnkv (k=5 and 6) and a correction coefficient Hv with the delayed signals W(n), thereby producing the sound field effect signals YV1 and YV2 corresponding respectively to the virtual sound sources VSS1 and VSS2. Among the sound image localization coefficients Cn1*r* to Cn4*r*, and Cn5*v* and Cn6*v*, or the total of six sound image localization coefficients, two or more coefficients are zero. A sound image can be localized at a position between the real sound sources RSSm (m=1 to 4) and the virtual sound source VSS1 (or the virtual sound source VSS2), by adjusting the magnitudes of these six sound image localization coefficients Cn1*r* to Cn6*v* and the correction coefficient Hr or Hv. In FIG. 7, namely, the gain controllers which multiply the products of the sound image localization coefficients Cn1*r* to Cn4*r* and the correction coefficient Hr with the delayed signals W(n) play the roles of the gain controllers 10*r* and 40*r* in FIG. 1 (or the gain controllers 10*r*1 and 10*r*2, 40*r*1 and 40*r*2 in FIG. 2), and the gain controllers which multiply the products of the sound image localization coefficient Cn5*v* or Cn6*v* and the correction coefficient Hr with the delayed signals W(n) play the roles of the gain controllers 10*v* and 40*v* in FIG. 1 (or FIG. 2). Namely, the sound field effect signal producing/processing section 70 of FIG. 7 cooperates with the adders 60-*m* (m=1 to 4) to play the role of the above-described real-sound source processing unit, and cooperates with the delaying units 50-*i* (i=1 and 2) to play the role of the above-described distributing unit. In the above-described principle of the invention, the sound image localization coefficient Cr (or Cv) and the correction coefficient Hr (or Hv) are multiplied with each other by the respective gain controllers. It is a matter of course that, as shown in FIG. 7, alternatively, the both coefficients may be multiplied with each other by a single gain controller (namely, the products of the coefficients may be multiplied with each other).

For example, the case will be considered where, at a first timing, one sound image is to be localized at a position on the straight line connecting the real sound source RSS1 and the virtual sound source VSS1, and, at a second timing which is different from the first timing, another sound image is to be localized at a position on the straight line connecting the real sound source RSS4 and the virtual sound source VSS2. In this case, at the first timing, the sound image localization coefficients other than the coefficients Cn1*r* and Cn5*r* are set to zero, and the values of the coefficients Cn1*r*, Cn5*v*, Hr, and Hv are determined so as to satisfy Exps. (1) and (2) above, and, at the second timing, the sound image localization coefficients other than the coefficients Cm4*r* and Cm6*v* are set to zero, and the values of the coefficients Cm4*r*, Cm6*v*, Hr, and Hv are determined so as to satisfy Exps. (1) and (2) above. As described above, when the sound image localization coefficients and the correction coefficient are determined so as to satisfy Exps. (1) and (2) above, it is possible to prevent the localization sensation of the virtual sound source from being impaired, and a sound image can be localized at a position between the virtual sound source and the real sound source.

According to the embodiment, as described above, a sound image can be satisfactorily localized in an arbitrary direction including the height direction without performing a complicated process and with a reduced number of speakers. In the above, the embodiment in which the real-sound source signals are supplied to the plurality of speakers (the speakers SP1 to SP4), and the virtual-sound source signals are supplied to two (i.e., the speakers SP1 and SP2) of the speakers to which the real-sound source signals are supplied has been described. Alternatively, a real-sound source signal(s) may be supplied to at least one of a plurality of speakers, and a virtual-sound source signal(s) may be supplied to at least one speaker including the speaker(s) to which the real-sound source signal(s) is supplied.

C: Modifications

In the above, the embodiment of the invention has been described. It is a matter of course that the embodiment may be modified in the following manners.

(1) In the above, the virtual-sound source signals are delayed with respect to the real-sound source signals. It is a matter of course that the real-sound source signals may be delayed with respect to the virtual-sound source signals. In the case where, in this way, the real-sound source signals are delayed with respect to the virtual-sound source signals, the gains Hr and Hv are adjusted so that the product Cr×Hr of the gain Cr in the gain controller 10*r* and the gain Hr in the gain controller 40*r* is larger than Cr which is the reference value, and $(Cr\times Hr)^2+(Cv\times Hv)^2=1$ is satisfied.

(2) In the above, the correction coefficients Hr and Hv are introduced, and the precedence effect caused by the delay of the virtual-sound source signals from the real-sound source signals is relaxed. In the case where the precedence effect does not so strongly appear, or, even when a slight degree of the precedence effect appears, the degree is within an allowable range, however, the correction by the correction coefficients is not essential.

According to an aspect of the invention, the second audio signal from which the virtual-sound source signal is produced has a time difference with respect to the first audio signal. In the case where a nonstationary signal for a usual music, movie, or television broadcasting is used as the input audio signal from which the first and second audio signals are produced, therefore, the correlation between the virtual-sound source signal and the first audio signal at the same time is low. Even when the virtual-sound source signal and the first audio signal are supplied to the same speaker to emit sounds, consequently, the localization sensation of the virtual sound source is not impaired. In this way, the sound image localization control apparatus of the invention does not have the limitation imposed on the technique disclosed in Patent Reference 1. In the apparatus, therefore, a sound image can be localized in an arbitrary direction including the height direction without increasing the number of speakers, or performing a complicated process such as that in which the virtual-sound source signal and the real-sound source signal are prevented from being supplied to the same speaker.

According to an aspect of invention, the precedence effect caused by the provision of a time difference between the first and second audio signals can be relaxed, and a sound image can be satisfactorily localized at a position between the virtual sound source and the real sound source. Patent References 3 to 6 disclose a technique in which, in order to prevent a problem of localization of a virtual sound source from arising in the case where surround right and left channels have a high correlation, the phases of the surround right and left channels are operated to realize decorrelation between the channels. However, the technique disclosed in Patent References 3 to 6 does not solve the problem caused in the case where a virtual-sound source signal and a real-sound source signal are supplied to the same speaker. If the virtual-sound source signal and the real-sound source signal are completely decorrelated with each other, moreover, it is impossible to attain the original object that sound image localization is realized by signal distribution. Therefore, the present invention is completely different from the technique disclosed in Patent References 3 to 6.

What is claimed is:

1. A sound image localization control apparatus comprising:

a distributing unit configured to produce first and second audio signals which have a time difference, from an input audio signal, and configured to supply the first audio signal to one of a plurality of speakers, the distributing unit including:

a delaying unit configured to provide a delay to one of the first and second audio signals to provide the time difference; and gain controllers, gains in the gain controllers corresponding to the first and second audio signals, respectively; and a virtual-sound source processing unit configured to produce a virtual-sound source signal for localizing a sound source at a virtual sound source position in a space where the plurality of speakers are disposed, which is to be supplied to the plurality of speakers, based on the second audio signal, wherein a reference value is one of the gains in the gain controllers in a case where a sound image is localized between a position of one of the plurality of speakers and a position which is the virtual sound source position; and the distributing unit determines the gains in the gain controllers so that one of the gains in the gain controllers corresponding to a succeeding one of the first and second audio signals to which the delay is provided has a value larger than the reference value.

2. The sound image localization control apparatus according to claim 1, wherein a sum of squares of the gains in the gain controllers has a constant value.

3. The sound image localization control apparatus according to claim 1, wherein the virtual sound source position is positioned at an upper side in the space.

4. A sound image localization control apparatus comprising:

a distributing unit configured to produce first and second audio signals which have a time difference, from an input audio signal, the distributing unit including:

a delaying unit configured to provide a delay to one of the first and second audio signals to provide the time difference; and gain controllers, gains in the gain controllers corresponding to the first and second audio signals, respectively;

a real-sound source processing unit configured to produce a real-sound source signal for localizing a sound source at a real sound source position, to be supplied to one of a plurality of speakers, based on the first audio signal; and a virtual-sound source processing unit configured to produce a virtual-sound source signal for localizing a sound source at a virtual sound source position in a space where the plurality of speakers are disposed, based on the second audio signal, and configured to supply the virtual-sound source signal to the plurality of speakers, wherein a reference value is one of the gains in the gain controllers in a case where a sound image is localized between a position of one of the real sound source position and a position which is the virtual sound source position; and the distributing unit determines the gains in the gain controllers so that one of the gains in the gain controllers corresponding to a succeeding one of the first and second audio signals to which the delay is provided has a value larger than the reference value.

5. A sound image localization control method comprising:

producing first and second audio signals which have a time difference, from an input audio signal;

supplying the first audio signal to one of a plurality of speakers;

producing a virtual-sound source signal for localizing a sound source at a virtual sound source position in a space where the plurality of speakers are disposed, based on the second audio signal; and supplying the virtual-sound source signal to the one of the plurality of speakers, wherein a delay is provided to one of the first and second audio signals to provide the time difference, and gains respectively corresponding to the first and second audio signals are adjusted so that one of the gains corresponding to a succeeding one of the first and second audio signals to which the delay is provided has a value larger than a reference value that is a gain in a case where a sound image is localized between a position of one of the plurality of speakers and a position which is the virtual sound source position.

* * * * *